US006467516B1

(12) United States Patent
Liao

(10) Patent No.: US 6,467,516 B1
(45) Date of Patent: Oct. 22, 2002

(54) WOOD PLANING MACHINE WITH AN INCLINING UNIT

(76) Inventor: Juei-Seng Liao, No. 295, Sec. 1, Nanking E. Rd., Taichung City (TW)

( * ) Notice: Subject to any disclaimer, the term of this patent is extended or adjusted under 35 U.S.C. 154(b) by 0 days.

(21) Appl. No.: 09/927,759

(22) Filed: Aug. 9, 2001

(30) Foreign Application Priority Data

Jun. 20, 2001 (TW) ..... 90210408 U

(51) Int. Cl.[7] ..... B27C 5/02

(52) U.S. Cl. ..... 144/253.8; 144/114.1; 144/253.5

(58) Field of Search ..... 144/114.1, 117.1, 144/129, 130, 251.1, 253.2, 253.5, 253.8; 83/467.1, 467.8

(56) References Cited

U.S. PATENT DOCUMENTS 5,533,557 A * 7/1996 Jedlicka et al. ..... 144/253.5
6,026,870 A * 2/2000 Liu ..... 144/253.5
6,250,349 B1 * 6/2001 Crofutt ..... 144/253.5

* cited by examiner

*Primary Examiner*—W. Donald Bray
(74) *Attorney, Agent, or Firm*—Trop, Pruner & Hu, P.C.

(57) ABSTRACT

A wood planing machine includes a work table, a workpiece guiding support and an inclining unit having a guiding seat secured to the work table, and first, second and third sliding members. The first sliding member is formed with a vertical groove and parallel wedge-shaped first and second grooves. The guiding seat is formed with a first wedge-shaped end. A fastening plate engages the guiding seat, has a second wedge-shaped end, and is movable to a locked position in which the first and second wedge-shaped ends wedge into the first and second grooves. The second sliding member is slidable along the vertical groove and has a concave face. The third sliding member has a convex face conforming to and slidable on the concave face so as to permit the workpiece guiding support to be inclinable relative to the work table.

1 Claim, 11 Drawing Sheets

WOOD PLANING MACHINE WITH AN INCLINING UNIT

CROSS-REFERENCE TO RELATED APPLICATION

This application claims priority of Taiwan patent Application No. 90210408, filed on Jun. 20, 2001.

BACKGROUND OF THE INVENTION

1. Field of the Invention

This invention relates to a wood planing machine, more particularly to a wood planing machine with an inclining unit for adjusting inclination of a workpiece guiding support.

2. Description of the Related art

FIGS. 1 to 4 illustrate a conventional wood planing machine 10 which includes a stand 11, a base 12 mounted on the stand 11, a rotary cutter 13 mounted in the base 12, horizontally extending left and right plates 14, 15 which are mounted on the base 12 and which define a work table for receiving a wooden workpiece thereon, a workpiece guiding support 16 projecting upwardly and inclinable relative to the work table, and an inclining unit 20 for adjusting inclination of the workpiece guiding support 16. The inclining unit 20 includes a guiding seat 21 that is secured to a rear side of the right plate 15 and that is formed with a lateral first groove 211 and a lateral slot 212, a first sliding member 22 that is mounted slidably on the guiding seat 21 and that has a lateral plate 222 and an upright plate 221 with a vertical groove 2211 at one side thereof and a vertical slot 2212 aligned with and in spatial communication with the vertical groove 2211, a second sliding member 24 mounted on the upright plate 221, slidable along the vertical groove 2211 and having a concave face 241, and a third sliding member 23 secured to a rear side of the workpiece guiding support 16 and having a convex face 231 that conforms to and that is slidable on the concave face 241. A curved slot 232 is formed in the convex face 231. The lateral plate 222 has a bottom side that is formed with a second groove 2221 vertically aligned with the first groove 211, and a rear side that is formed with a retaining hole 2222. An elongated guide piece 27 is received in the first and second grooves 211, 2221, and is fixed on the guiding seat 21 so as to permit the first sliding member 22 to be slidable on the guiding seat 21. A first tightening unit includes a screw rod 252 extending through the lateral slot 212 in the guiding seat 21, a first nut member 253 disposed underneath the guiding seat 21 and threadedly engaging the screw rod 252 so as to tighten the first sliding member 22 relative to the guiding seat 21, an eccentric lever 251 extending through a head of the screw rod 252 and into the retaining hole 2222 in the lateral plate 22 and turnable for fastening and loosening the first sliding member 22 on the guiding seat 21, and a handle 254 associated with the eccentric lever 2521 for turning the latter. A second tightening unit includes a second nut member 263 disposed at and capable of abutting against the other side of the upright plate 221, and a threaded rod 252 threadedly engaging the second nut member 263 and extending through the second nut member 263, the vertical slot 2212, the vertical groove 2211, the second sliding member 24, and the curved slot 232 in the convex face 232 to connect with an anchored member 261 which spans the curved slot 232. A handle 264 is connected to the second screw rod 262 for driving the second nut member 263 toward the upright plate 221 SO as to fasten the second sliding member 24 to the third sliding member 23, and away from the upright plate 221 SO as to loosen the second sliding member 24 from the third sliding member 23.

The wood planing machine 10 is disadvantageous in that the sliding movement of the first sliding member 22 on the guiding seat 21 is not smooth since it relies only on a single rail, i.e. the guide piece 27.

SUMMARY OF THE INVENTION

Therefore, it is an object of the present invention to provide a wood planing machine that is capable of overcoming the disadvantage described above.

Accordingly, a wood planing machine of this invention comprises: a main support having a laterally extending work table that has front and rear sides; a rotary cutter mounted on the main support and disposed underneath the work table; a workpiece guiding support projecting upwardly from the rear side of the work table and inclinable relative to the work table; an inclining unit including a guiding seat that is secured to and that projects laterally and rearwardly from the rear side of the work table, a first sliding member that has a lateral plate which is slidable on the guiding seat in a first lateral direction toward and away from the workpiece guiding support, and an upright plate which projects uprightly from the lateral plate and which is formed with a vertical groove at one side thereof and a vertical slot aligned with and in spatial communication with the vertical groove, the lateral plate having a bottom that is formed with parallel wedge-shaped first and second grooves which extend in the first lateral direction, the guiding seat being formed with a lateral slot and a lateral guide rail that has a first wedge-shaped end which is capable of wedging into the first groove, a second sliding member that is mounted and that is slidable on the upright plate along the vertical groove, and that has a concave face, and a third sliding member that is secured to and that projects from the workpiece guiding support, and that has a convex face which conforms to and which is slidable on the concave face so as to permit the workpiece guiding support to be inclinable relative to the work table, the third sliding member being formed with a curved slot at the convex face; a first tightening unit including a fastening plate that extends through the lateral slot, that has a second wedge-shaped end, and that is movable in a second lateral direction transverse to the first lateral direction between a locked position, in which, the first and second wedge-shaped ends wedge into the first and second grooves to abut frictionally against the first sliding member so as to prevent the first sliding member from sliding on the guiding seat, and an unlocked position, in which, the second wedge-shaped end moves away from the second groove so as to disengage the first and second wedge-shaped ends from the first and second grooves and so as to cooperate with the first wedge-shaped end to form a guide rail that permits the first sliding member to be slidable thereon, the first tightening unit further including a first screw rod that is mounted on the guiding seat and that threadedly engages the fastening plate so as to move the fastening plate between the locked and unlocked positions; and a second tightening unit including a nut member that is disposed at the other side of the upright plate, an anchored member that is disposed at one side of the third sliding member opposite to the second sliding member and that spans the curved slot, and a second screw rod that threadedly engages the nut member, that extends through the nut member, the vertical slot, the vertical groove, the second sliding member, and the curved slot to connect with the anchored member, and that is turnable so as to drive the nut member toward the upright plate to tighten the second and third sliding members relative to the upright plate.

BRIEF DESCRIPTION OF THE DRAWINGS

In drawings which illustrate an embodiment of the invention.

DETAILED DESCRIPTION OF THE PREFERRED EMBODIMENT

Figure 1:
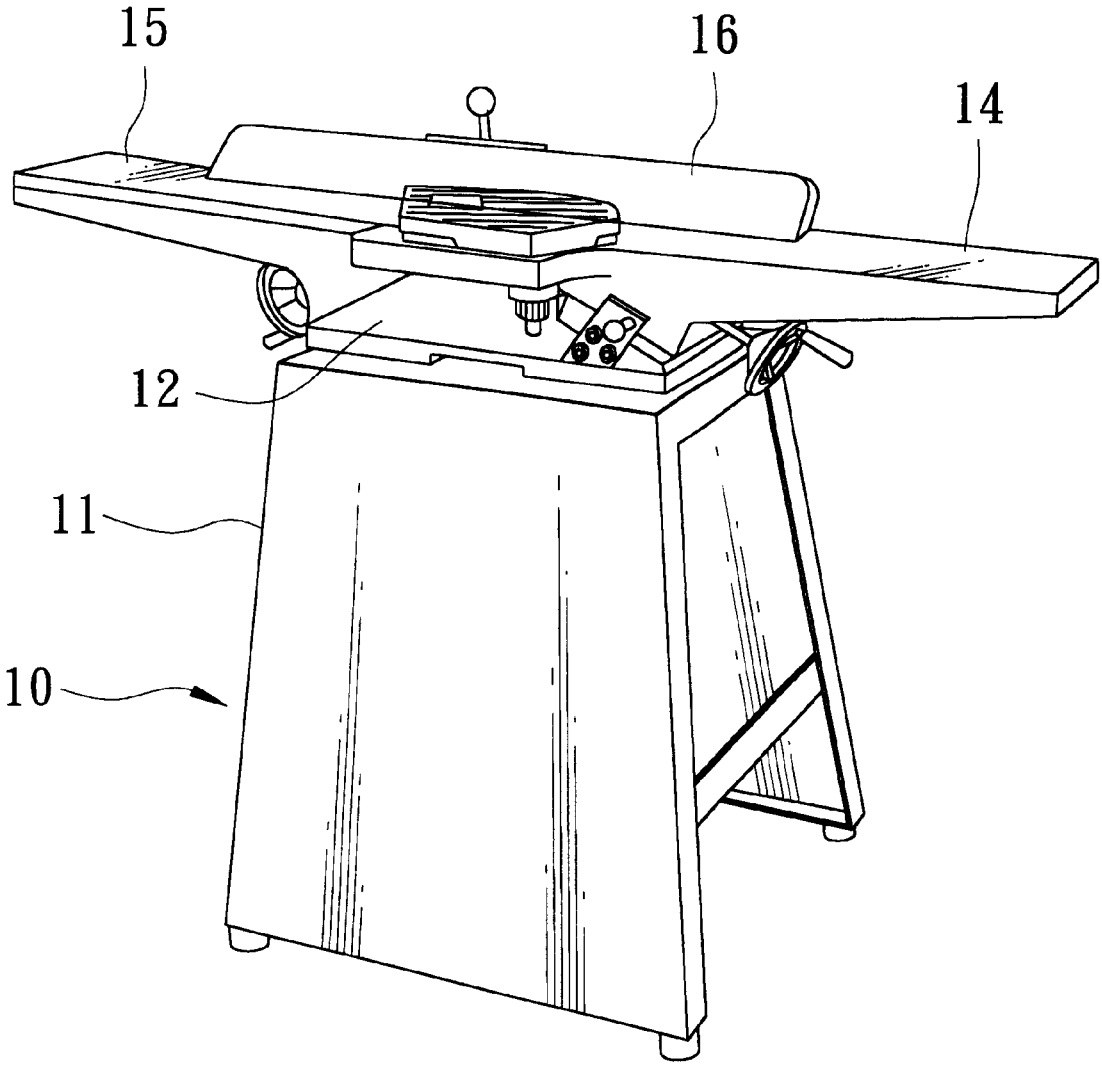
FIG. 1 PRIOR ART
FIG. 1 is a perspective view of a conventional wood planing machine.
Figure 2:
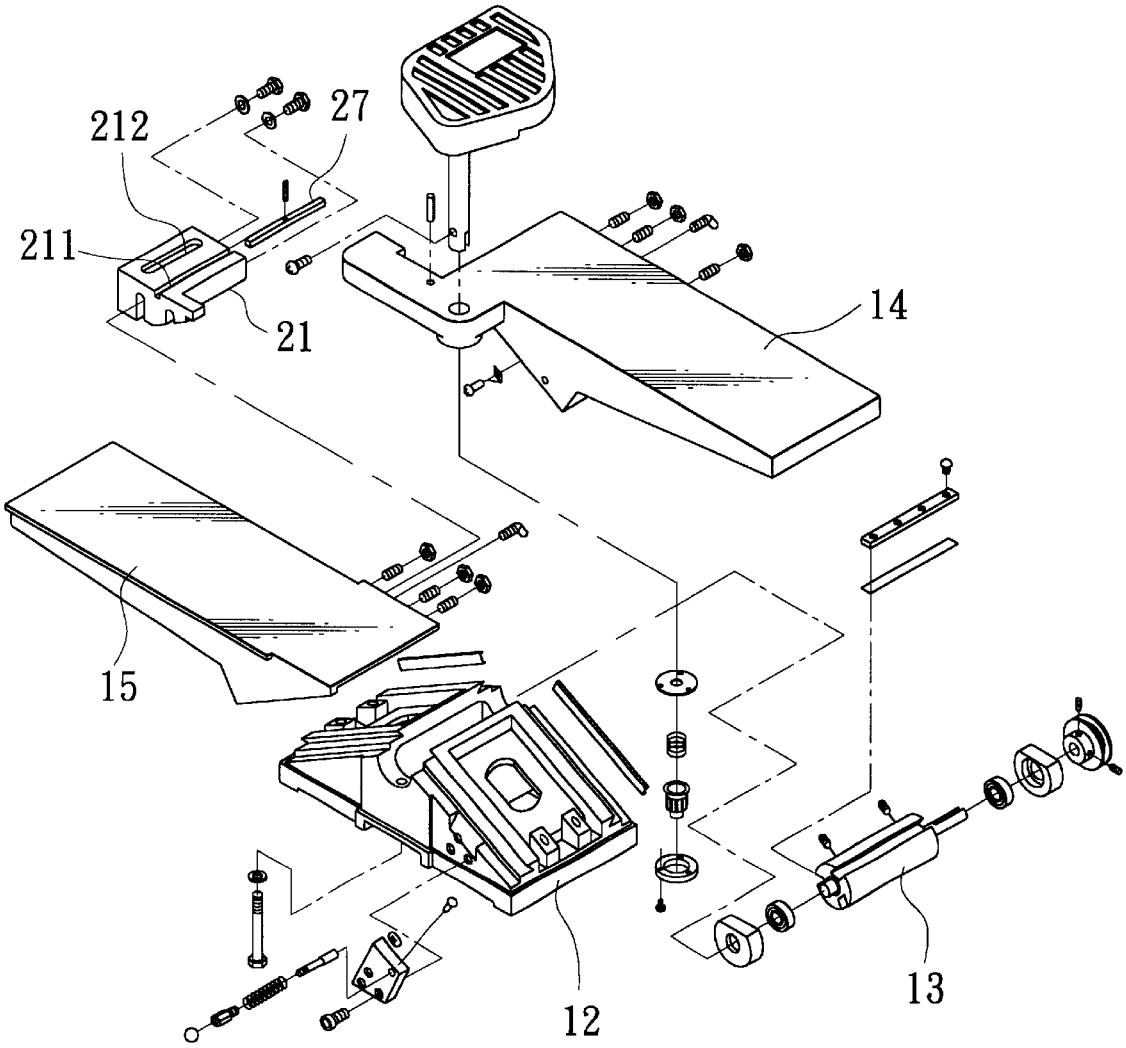
FIG. 2 PRIOR ART
FIG. 2 is a fragmentary exploded view of the wood planing machine of FIG. 1.
Figure 3:
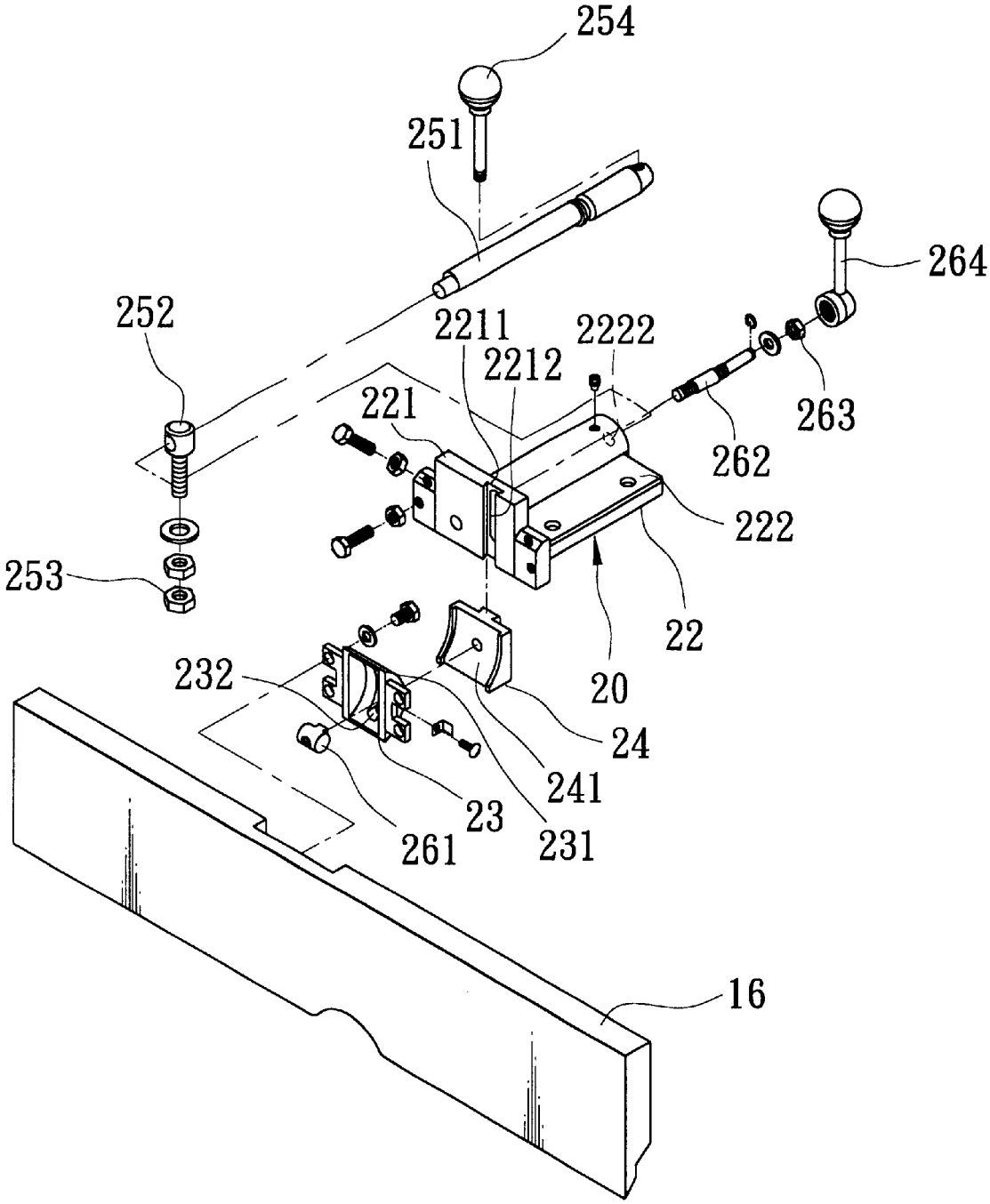
FIG. 3 PRIOR ART
FIG. 3 is an exploded view of an inclining unit of the wood planing machine of FIG. 1.
Figure 4:
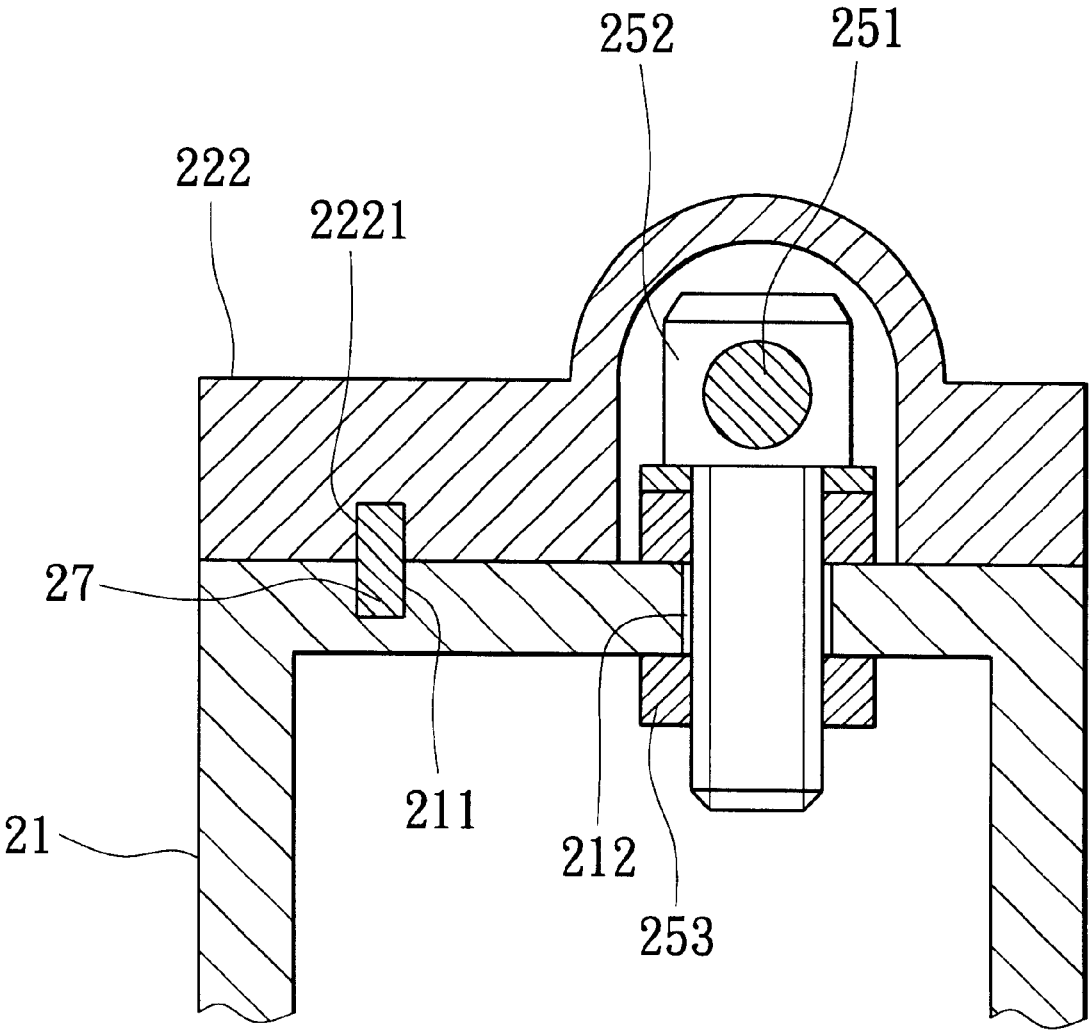
FIG. 4 PRIOR ART
FIG. 4 is fragmentary partly sectional view of a tightening unit and a guide piece of the wood planing machine of FIG. 1.
Figure 5:
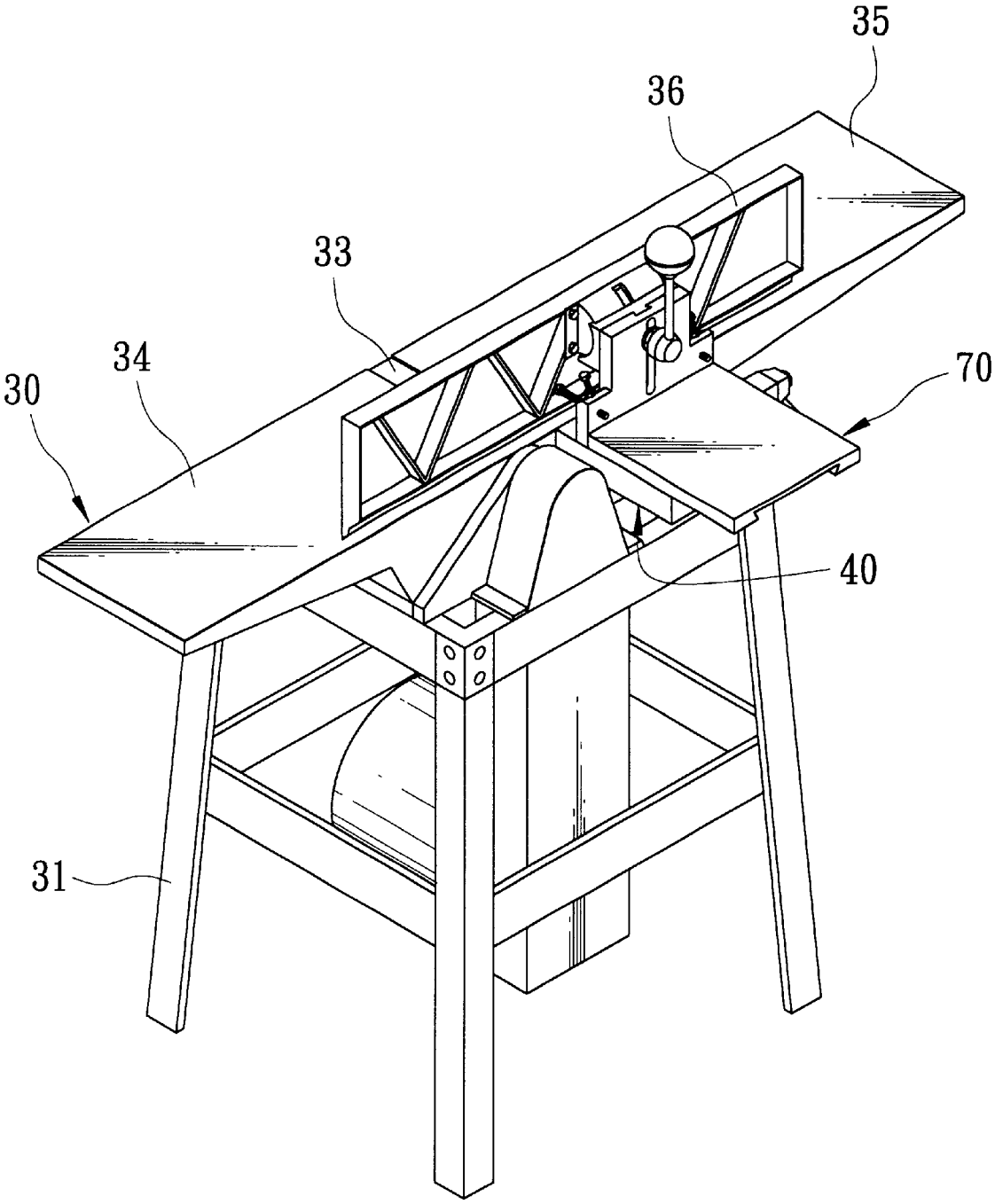
FIG. 5 is a perspective view of a wood planing machine embodying this invention.
Figure 6:
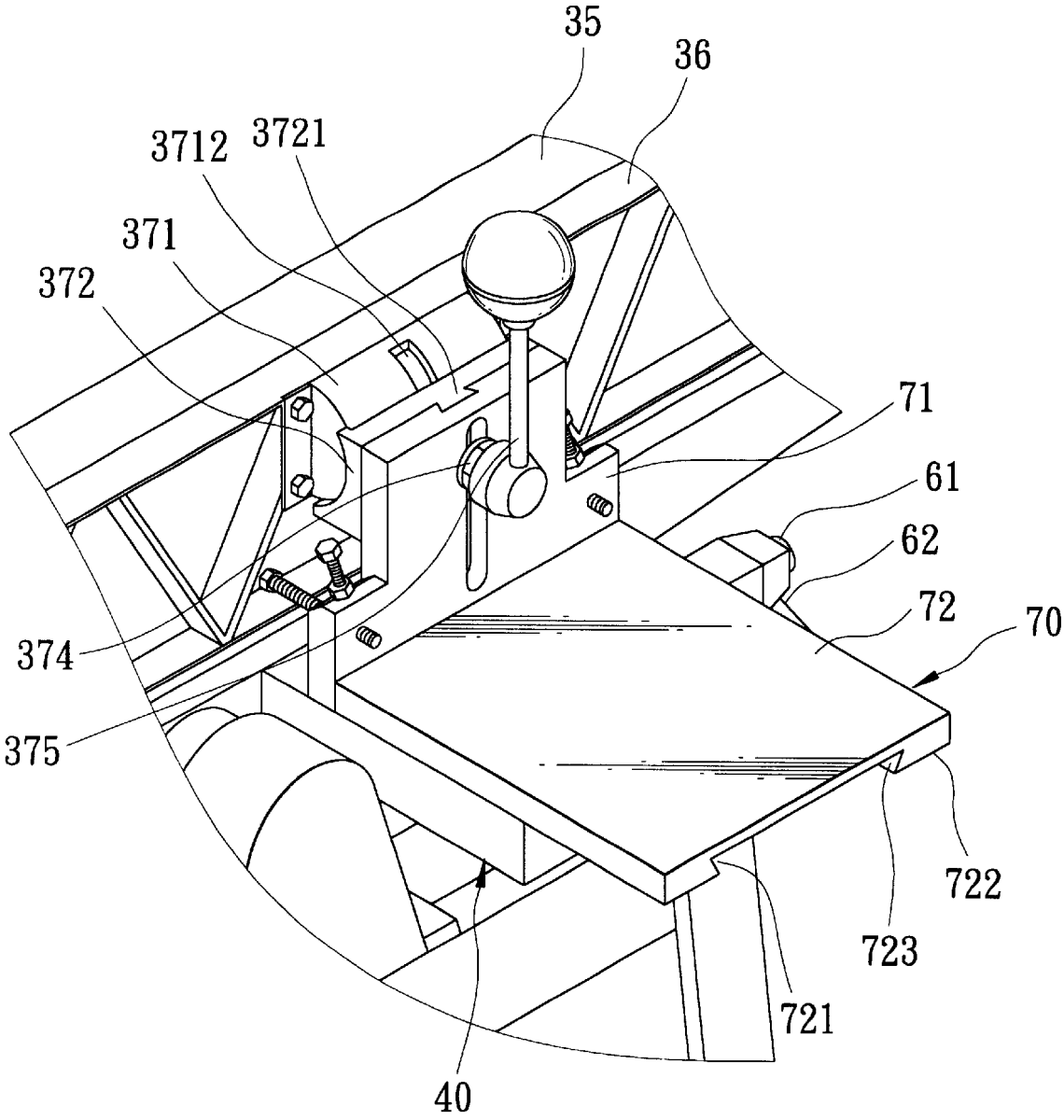
FIG. 6 is a fragmentary perspective view of the wood planing machine of FIG. 5.

FIGS. 5 to 9 illustrate a wood planing machine embodying this invention. The wood planing machine includes a main support 31, a laterally extending work table 30 having front and rear sides, mounted on the main support 31 and composed of opposing left and right plates 34, 35, a rotary cutter 33 mounted on the main support 31 underneath the work table 30, a workpiece guiding support 36 projecting upwardly from the rear side of the work table 30 and inclinable relative to the work table 30, an inclining unit disposed behind the workpiece guiding support 36, and first and second tightening units for fastening the inclining unit and the workpiece guiding support 36 to the work table 30.

The inclining unit includes a guiding seat 40 that is secured to and that projects laterally and rearwardly from the rear side of the work table 30, and a first sliding member 70 that has a lateral plate 72 which is slidable on the guiding seat 40 in a first lateral direction toward and away from the workpiece guiding support 36, and an upright plate 71 which projects uprightly from the lateral plate 72 and which is formed with a vertical groove 711 at one side thereof and a vertical slot 712 aligned with and in spatial communication with the vertical groove 711. The lateral plate 72 has a bottom 722 that is formed with parallel wedge-shaped first and second grooves 721, 723 which extend in the first lateral direction. The guiding seat 40 has a top 43 formed with a lateral slot 45 and a lateral guide rail 44 that has a first wedge-shaped end 441 which extends in the first lateral direction and which is capable of wedging into the first groove 721. A second sliding member 372 has a protrusion guide 3721 projecting from one side thereof and inserted into the vertical groove 711 so as to permit the second sliding member 372 to be slidable on the upright plate 71 along the vertical groove 711, and a concave face 3722 at the other side thereof. A third sliding member 371 is secured to and projects from a back side of the workpiece guiding support 36, and has a convex face 3711 which conforms to and which is slidable on the concave face 3722 so as to permit the workpiece guiding support 36 to be inclinable relative to the work table 30. A curved slot 3712 is formed in the third sliding member 371 at the convex face 3711.

Figure 10:
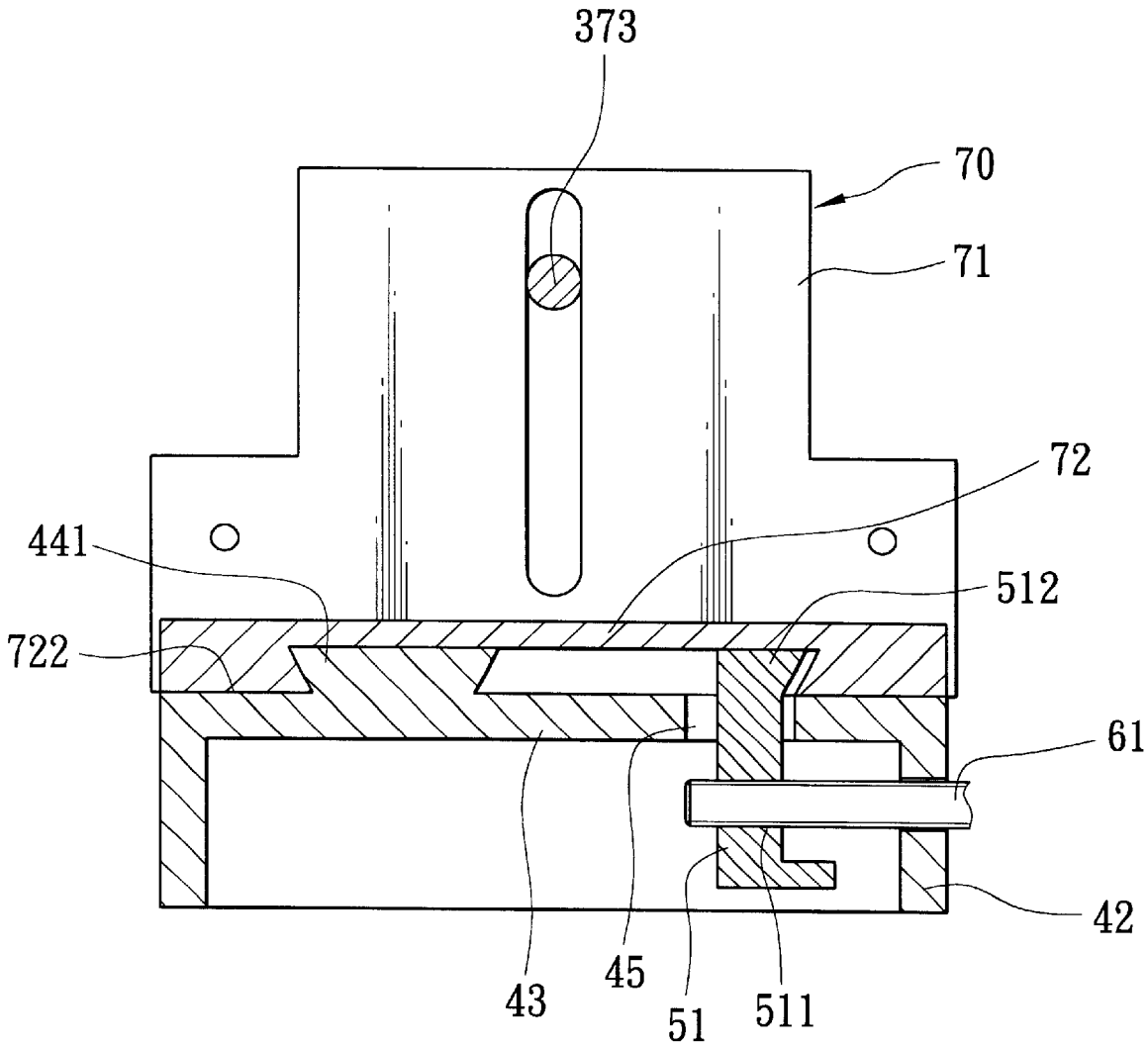
FIG. 10 is a fragmentary schematic sectional view to illustrate the fastening plate of the wood planing machine of FIG. 5, which is disposed at an unlocked position.

The first tightening unit includes a fastening plate 51 that is transverse to and that extends through the lateral slot 45, that has a second wedge-shaped end 512, and that is movable within the lateral slot 45 in a second lateral direction transverse to the first lateral direction between a locked position (see FIG. 9), in which, the first and second wedge-shaped ends 441, 512 wedge into the first and second grooves 721, 723 to abut frictionally against the first sliding member 72 so as to prevent the first sliding member 72 from sliding on the guiding seat 40, and an unlocked position (see FIG. 10), in which, the second wedge-shaped end 512 moves away from the second groove 723 so as to disengage the first and second wedge-shaped ends 441, 512 from the first and second grooves 721, 723 and so as to cooperate with the first wedge-shaped end 441 to form a guide rail that permits the first sliding member 72 to slide thereon. An inner threaded hole 511 is formed in the fastening plate 51. The first tightening unit further includes a first screw rod 61 that is mounted on and that extends through a side wall 42 of the guiding seat 40 and into the inner threaded hole 511 in the fastening plate 51 to threadedly engage the fastening plate 51 so as to move the fastening plate 51 between the locked and unlocked positions. A first handle 62 is connected to the first screw rod 61 for turning the latter.

A second tightening unit includes a nut member 374 that is disposed at and that is capable of abutting against the other side of the upright plate 71, an anchored member 376 that is disposed at one side of the third sliding member 371 opposite to the second sliding member 372 and that spans the curved slot 3712, and a second screw rod 373 that extends in the lateral direction through the nut member 374, the vertical slot 712, the vertical groove 711, the second sliding member 372, and the curved slot 3712 to connect with the anchored member 376. A second handle 375 is connected to the second screw rod 373 for turning the latter, which, in turn, drives the nut member 374 toward the upright plate 71 so as to tighten the second and third sliding members 372, 371 relative to the upright plate 71 and so as to prevent the third sliding member 371 from sliding on the second sliding member 372 and the second sliding member 372 from sliding on the upright plate 71 of the first sliding member 70, and away from the upright plate 71 so as to loosen the second and third sliding members 372, 371 from the upright plate 71, thereby permitting the third sliding member 371 to be slidable on the second sliding member 372.

Figure 7:
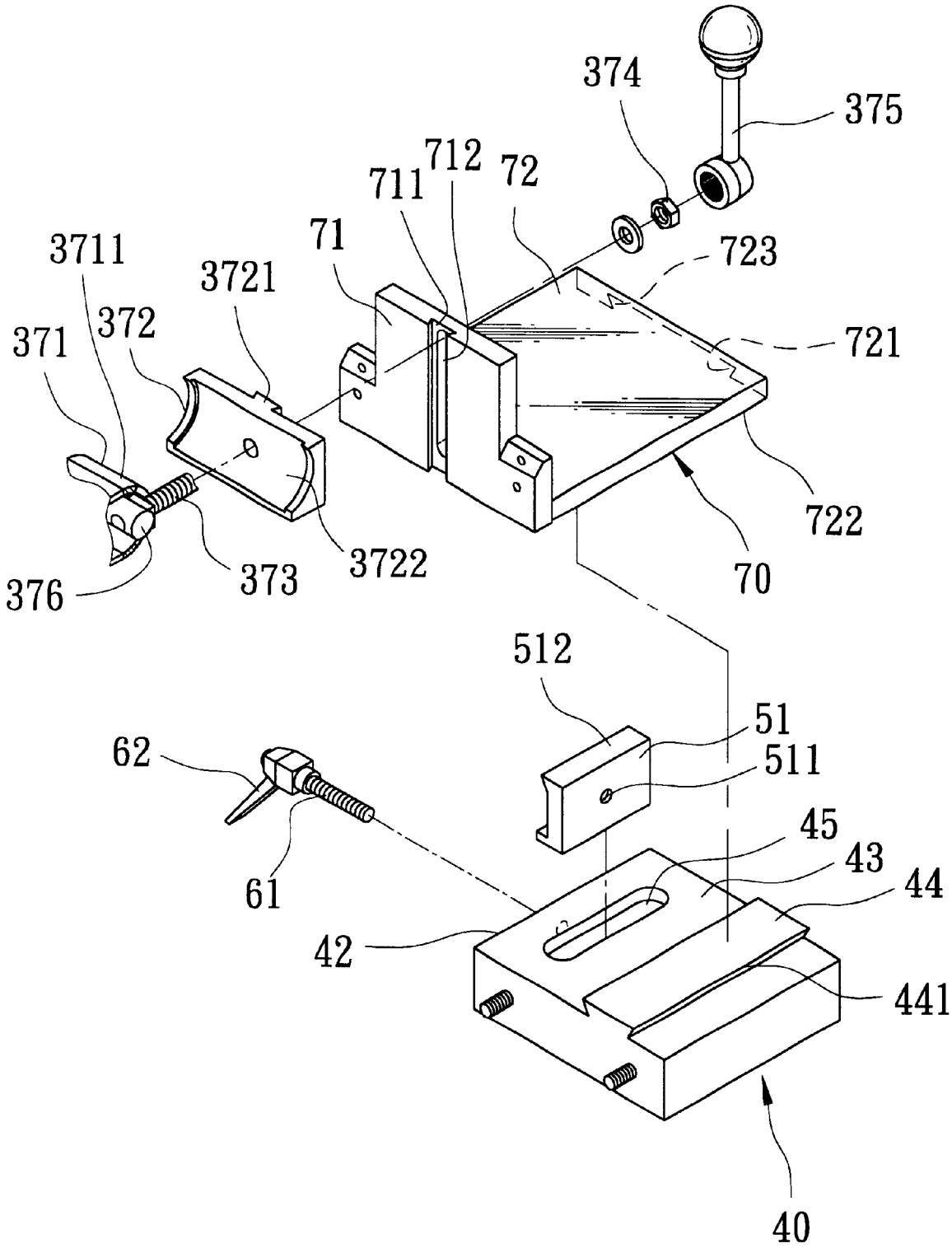
FIG. 7 is an exploded perspective view of an inclining unit of the wood planing machine of FIG. 5.
Figure 8:
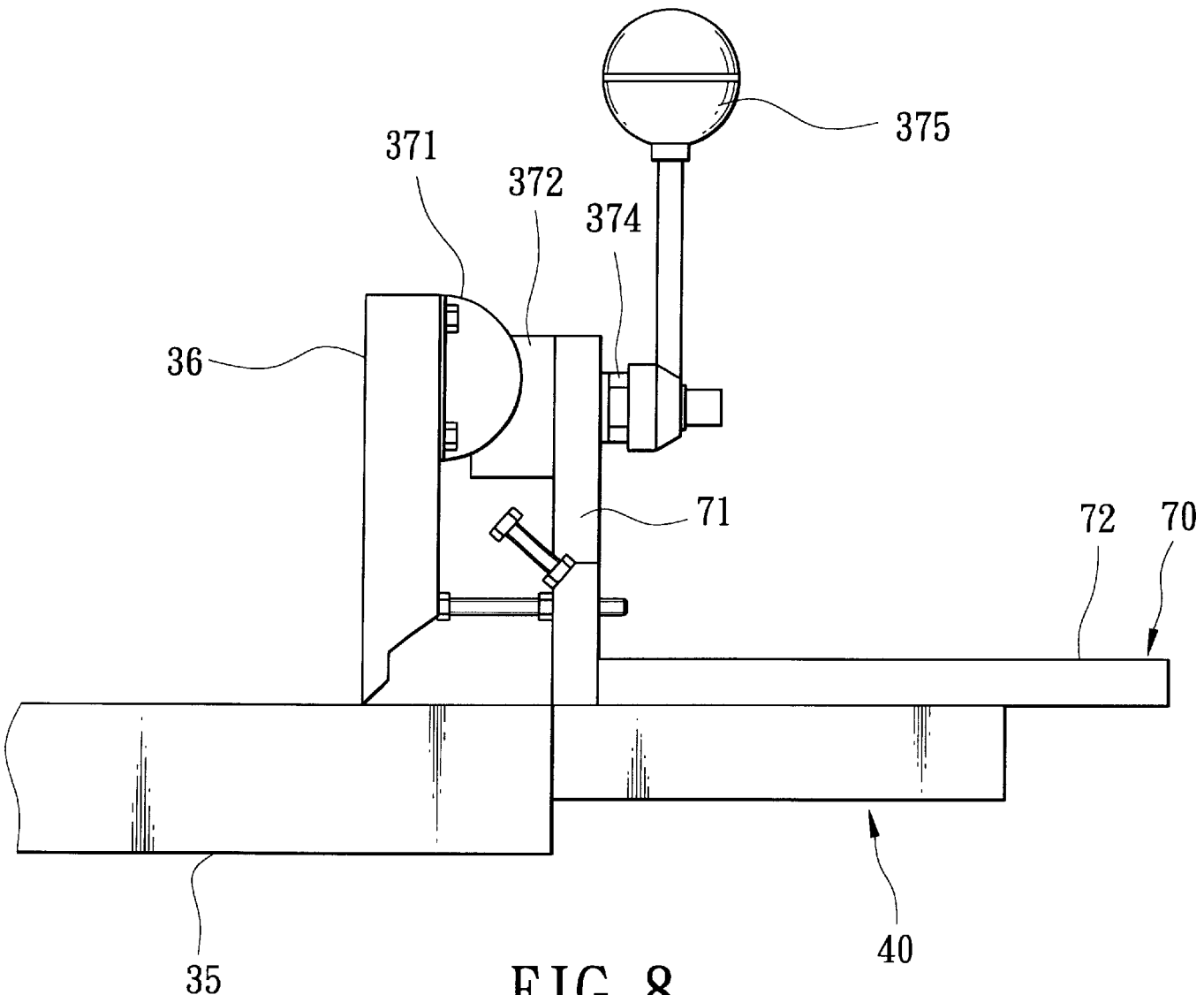
FIG. 8 is a fragmentary schematic side view to illustrate a workpiece guiding support of the wood planing machine of FIG. 5, at anon-inclined position.
Figure 9:
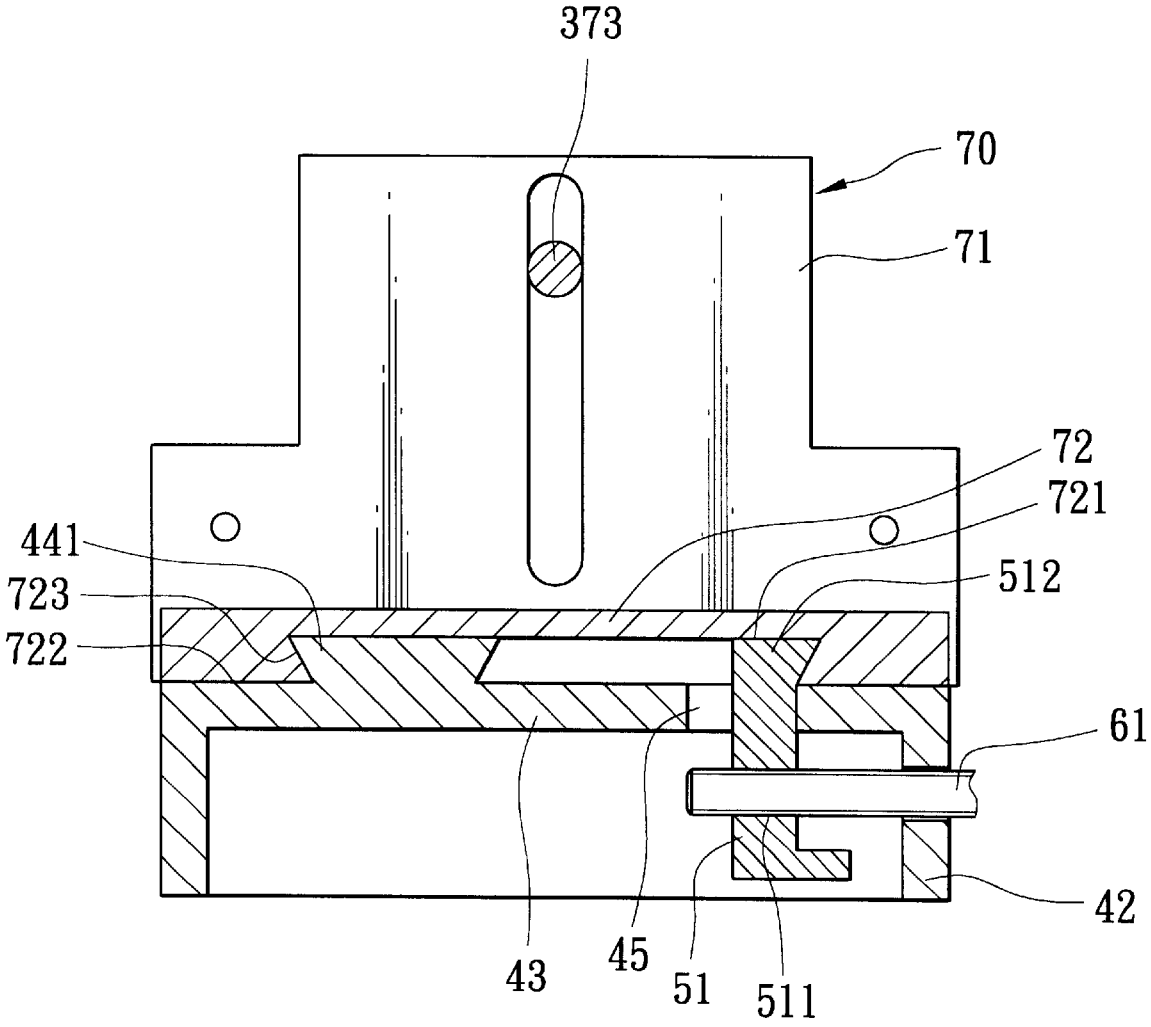
FIG. 9 is a fragmentary schematic sectional view to illustrate a fastening plate of the wood planing machine of FIG. 5, which is disposed at a locked position.
Figure 11:
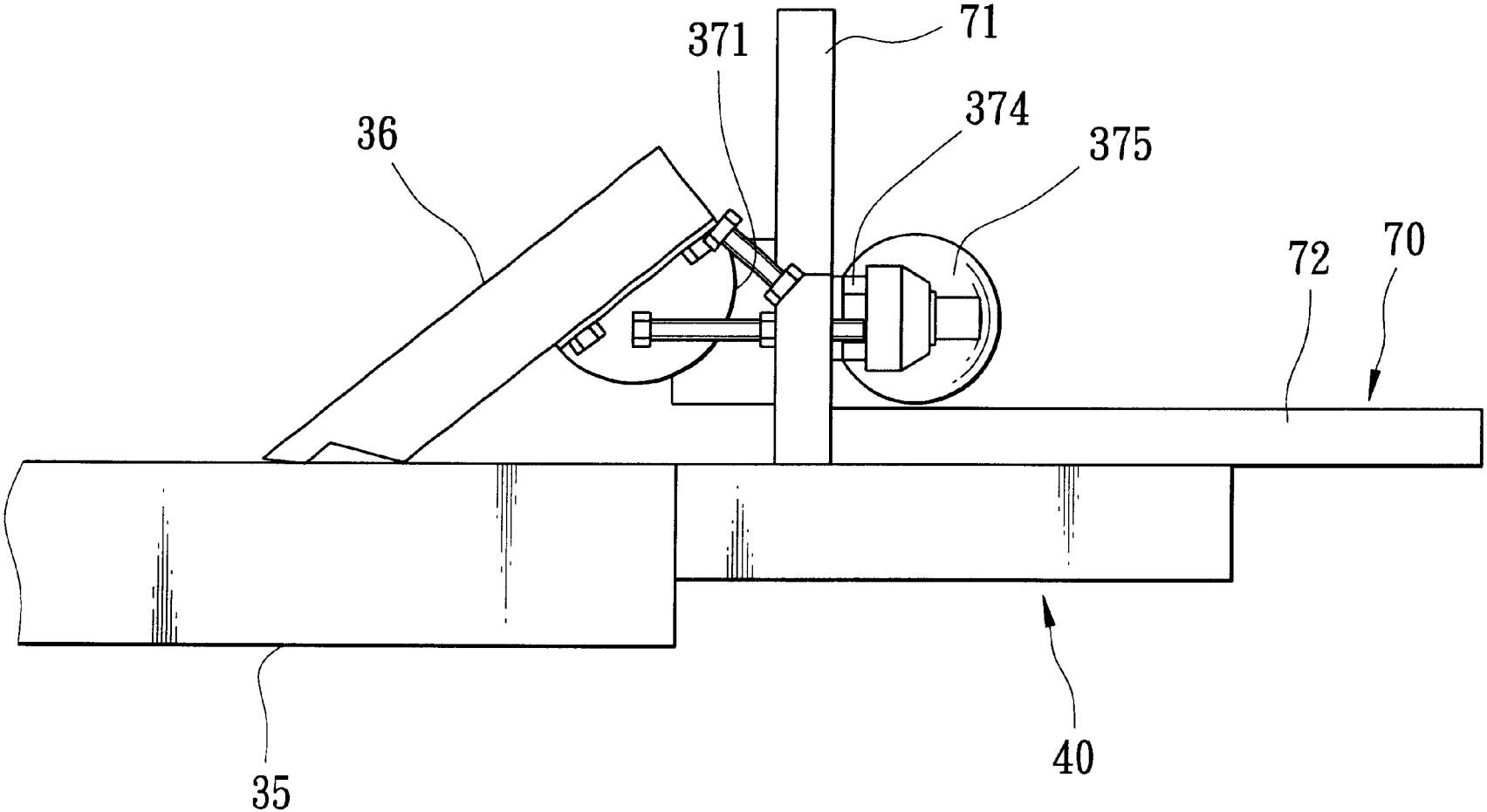
FIG. 11 is a fragmentary schematic side view to illustrate the workpiece guiding support of the wood planing machine of FIG. 5, at an inclined position.

Referring to FIG. 11, in combination with FIG. 7, to adjust the inclination of the workpiece guiding support 36 relative to the work table 30, the fastening plate 51 and the third sliding member 371 are respectively loosened from the first sliding member 70 and the second sliding member 372, and a top end of the workpiece guiding support 36 is subsequently pressed downwardly, which results in concurrent sliding movements of the first, second and third sliding members 70, 372, 371. The fastening plate 51 and the third sliding member 371 are respectively re-tightened to the first sliding member 70 and the second sliding member 372 after a desired inclination of the workpiece guiding support 36 is achieved.

Since the first sliding member 70 slides on the guiding seat 40 via the first and second wedge-shaped ends 441, 512, which serve as a double-rail for the first sliding member 70, the drawback associated with the prior art can be eliminated.

With the invention thus explained, it is apparent that various modifications and variations can be made without departing from the spirit of the present invention. It is therefore intended that the invention be limited only as recited in the appended claims.

I claim:

1. A wood planing machine comprising:

a main support having a laterally extending work table that has front and rear sides;

a rotary cutter mounted on said main support and disposed underneath said work table;

a workpiece guiding support projecting upwardly from said rear side of said work table and inclinable relative to said work table;

an inclining unit including a guiding seat that is secured to and that projects laterally and rearwardly from said rear side of said work table;

a first sliding member that has a lateral plate which is slidable on said guiding seat in a first lateral direction toward and away from said workpiece guiding support, and an upright plate which projects uprightly from said lateral plate and which is formed with a vertical groove at one side thereof and a vertical slot aligned with and in spatial communication with said vertical groove, said lateral plate having a bottom that is formed with parallel wedge-shaped first and second grooves which extend in said first lateral direction, said guiding seat being formed with a lateral slot and a lateral guide rail that has a first wedge-shaped end which is capable of wedging into said first groove, a second sliding member that is mounted and that is slidable on said upright plate along said vertical groove, and that has a concave face, and a third sliding member that is secured to and that projects from said workpiece guiding support, and that has a convex face which conforms to and which is slidable on said concave face so as to permit said workpiece guiding support to be inclinable relative to said work table, said third sliding member being formed with a curved slot at said convex face;

a first tightening unit including a fastening plate that extends through said lateral slot, that has a second wedge-shaped end, and that is movable in a second lateral direction transverse to said first lateral direction between a locked position, in which, said first and second wedge-shaped ends wedge into said first and second grooves to abut frictionally against said first sliding member so as to prevent said first sliding member from sliding on said guiding seat, and an unlocked position, in which, said second wedge-shaped end moves away from said second groove so as to disengage said first and second wedge-shaped ends from said first and second grooves and so as to cooperate with said first wedge-shaped end to form a guide rail that permits said first sliding member to be slidable thereon, said first tightening unit further including a first screw rod that is mounted on said guiding seat and that threadedly engages said fastening plate so as to move said fastening plate between said locked and unlocked positions; and a second tightening unit including a nut member that is disposed at the other side of said upright plate, an anchored member that is disposed at one side of said third sliding member opposite to said second sliding member and that spans said curved slot, and a second screw rod that threadedly engages said nut member, that extends through said nut member, said vertical slot, said vertical groove, said second sliding member, and said curved slot to connect with said anchored member, and that is turnable so as to drive said nut member toward said upright plate to tighten said second and third sliding members relative to said upright plate.

* * * * *